US006182388B1

(12) United States Patent
Patton

(10) Patent No.: US 6,182,388 B1
(45) Date of Patent: Feb. 6, 2001

(54) BELT BUCKLE WITH REMOVABLE DISPLAY INSERT

(76) Inventor: Kenneth D. Patton, 91-1031 Kauno'A St., Ewa Beach, HI (US) 96706

( * ) Notice: Under 35 U.S.C. 154(b), the term of this patent shall be extended for 0 days.

(21) Appl. No.: 09/282,930

(22) Filed: Apr. 1, 1999

(51) Int. Cl.[7] ..... G09F 23/00
(52) U.S. Cl. ..... 40/640; 40/776; 24/163 K
(58) Field of Search ..... 40/640, 770, 771, 40/775, 776; 24/163 K

(56) References Cited

U.S. PATENT DOCUMENTS 1,825,045 * 9/1931 Blickhahn ..... 40/640
1,882,475 * 10/1932 Blickhahn ..... 40/640
3,274,721 * 9/1966 Dreyer ..... 40/771
4,052,773 * 10/1977 Nesbitt ..... 40/640 X
4,170,808 * 10/1979 Knowles ..... 40/640 X
4,570,308 * 2/1986 Weisgerber ..... 40/640 X
4,771,557 * 9/1988 Bowman ..... 40/776 X
5,197,213 * 3/1993 Borden ..... 40/770 X
5,201,525 * 4/1993 Castro ..... 40/771 X
5,245,775 * 9/1993 Goserud ..... 40/642
5,259,136 * 11/1993 Goserud ..... 40/771 X
5,335,433 * 8/1994 Borden ..... 40/770 X

* cited by examiner

*Primary Examiner*—Terry Lee Melius
*Assistant Examiner*—James M Hewitt

(57) ABSTRACT

A belt buckle with removable display insert for displaying an image on a belt buckle. The belt buckle with removable display insert includes a frame with a central opening. A decorative insert is disposed in the central opening of the frame. A backing plate is mounted to a back face of the frame to close the central opening from the back face of the frame so that the decorative insert is visible from the front face of the frame.

6 Claims, 3 Drawing Sheets

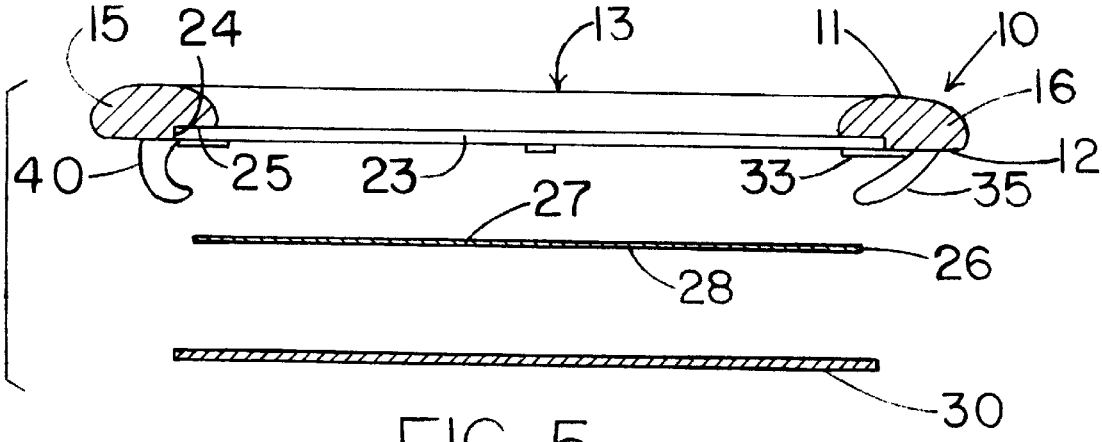
FIG. 5
FIG. 6
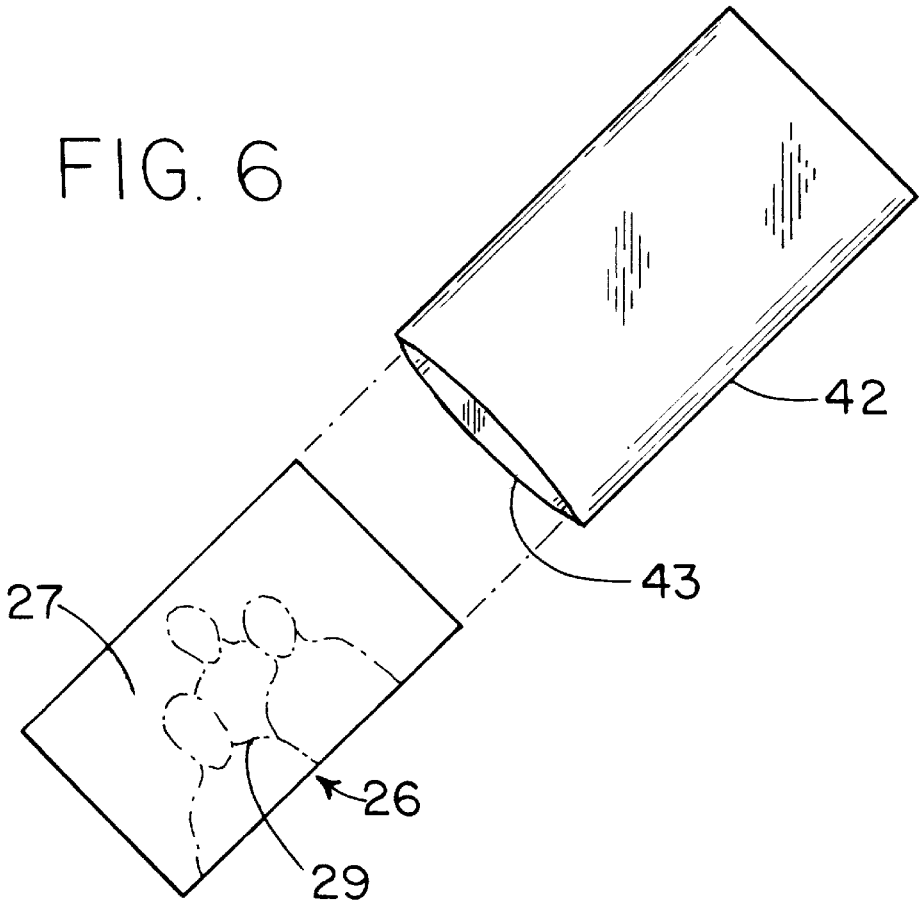

BELT BUCKLE WITH REMOVABLE DISPLAY INSERT

BACKGROUND OF THE INVENTION

1. Field of the Invention

The present invention relates to belt buckles and more particularly pertains to a new belt buckle with removable display insert for displaying an image on a belt buckle.

2. Description of the Prior Art

The use of belt buckles is known in the prior art. More specifically, belt buckles heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,088,234 by Lesser et al.; U.S. Pat. No. 4,052,773 by Nesbitt; U.S. Pat. No. 3,969,836 by DuBois; U.S. Pat. No. 4,972,557 by Williams; U.S. Pat. No. 4,502,188 by Kohli; and U.S. Pat. No. Des. 78,173.

While these devices fulfill their respective, particular objectives and requirements, the aforementioned patents do not disclose a new belt buckle with removable display insert. The inventive device includes a frame with a central opening. A decorative insert is disposed in the central opening of the frame. A backing plate is mounted to a back face of the frame to close the central opening from the back face of the frame so that the decorative insert is visible from the front face of the frame.

In these respects, the belt buckle with removable display insert according to the present invention substantially departs from the conventional concepts and designs of the prior art, and in so doing provides an apparatus primarily developed for the purpose of displaying an image on a belt buckle.

SUMMARY OF THE INVENTION

In view of the foregoing disadvantages inherent in the known types of belt buckles now present in the prior art, the present invention provides a new belt buckle with removable display insert construction wherein the same can be utilized for displaying an image on a belt buckle.

The general purpose of the present invention, which will be described subsequently in greater detail, is to provide a new belt buckle with removable display insert apparatus and method which has many of the advantages of the belt buckles mentioned heretofore and many novel features that result in a new belt buckle with removable display insert which is not anticipated, rendered obvious, suggested, or even implied by any of the prior art belt buckles, either alone or in any combination thereof.

To attain this, the present invention generally comprises a frame with a central opening. A decorative insert is disposed in the central opening of the frame. A backing plate is mounted to a back face of the frame to close the central opening from the back face of the frame so that the decorative insert is visible from the front face of the frame.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new belt buckle with removable display insert apparatus and method which has many of the advantages of the belt buckles mentioned heretofore and many novel features that result in a new belt buckle with removable display insert which is not anticipated, rendered obvious, suggested, or even implied by any of the prior art belt buckles, either alone or in any combination thereof.

It is another object of the present invention to provide a new belt buckle with removable display insert which may be easily and efficiently manufactured and marketed.

It is a further object of the present invention to provide a new belt buckle with removable display insert which is of a durable and reliable construction.

An even further object of the present invention is to provide a new belt buckle with removable display insert which is susceptible of a low cost of manufacture with regard to both materials and labor, and which accordingly is then susceptible of low prices of sale to the consuming public, thereby making such belt buckle with removable display insert economically available to the buying public.

Still yet another object of the present invention is to provide a new belt buckle with removable display insert which provides in the apparatuses and methods of the prior art some of the advantages thereof, while simultaneously overcoming some of the disadvantages normally associated therewith.

Still another object of the present invention is to provide a new belt buckle with removable display insert for displaying an image on a belt buckle.

Yet another object of the present invention is to provide a new belt buckle with removable display insert which includes a frame with a central opening. A decorative insert is disposed in the central opening of the frame. A backing plate is mounted to a back face of the frame to close the central opening from the back face of the frame so that the decorative insert is visible from the front face of the frame.

Still yet another object of the present invention is to provide a new belt buckle with removable display insert that lets a user display a personal photo therewith.

Even still another object of the present invention is to provide a new belt buckle with removable display insert that lets a user replace the display insert as often as they desire.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a schematic exploded cross sectional view of the present invention.

FIG. 6 is a schematic exploded plan view of the display insert and the sleeve of the present invention.

DESCRIPTION OF THE PREFERRED EMBODIMENT

Figure 2:
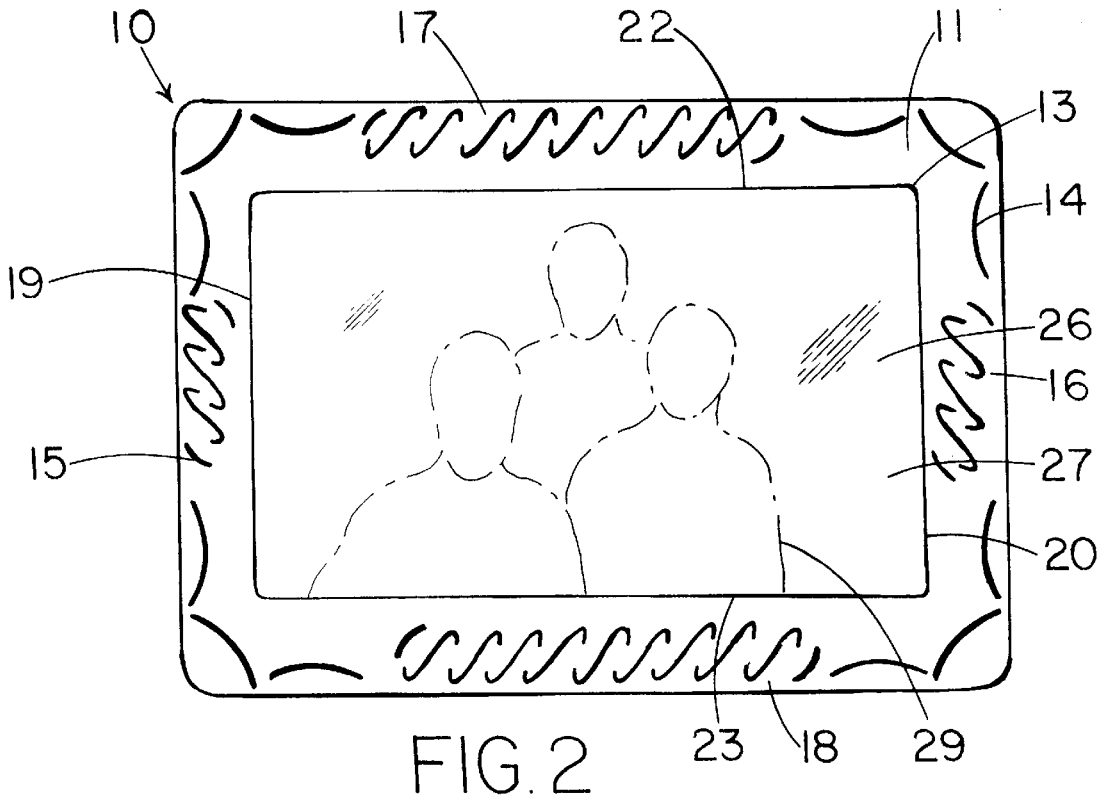
FIG. 2 is a schematic front view of the present invention.
Figure 1:
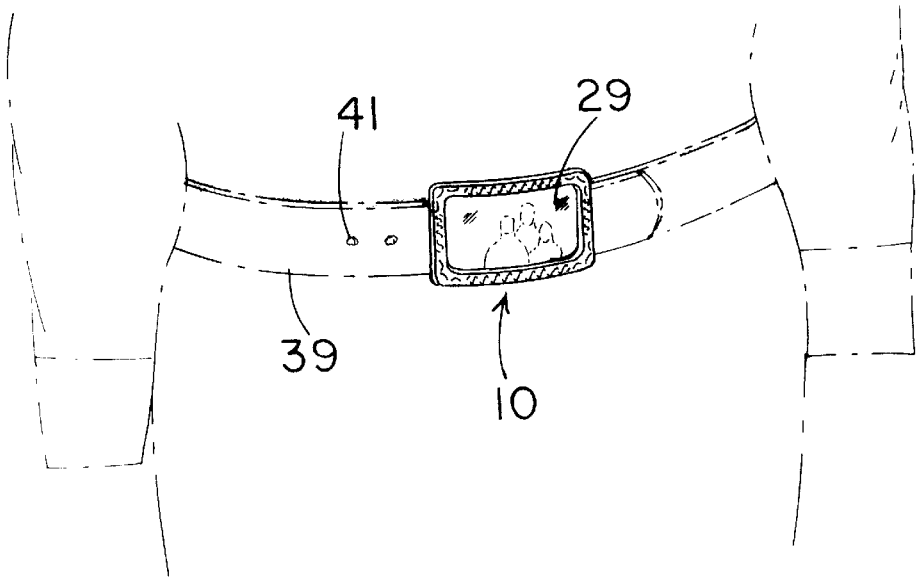
FIG. 1 is a schematic perspective view of a new belt buckle with removable display insert in use on a belt around the waist of a user according to the present invention.

With reference now to the drawings, and in particular to FIGS. 1 through 6 thereof, a new belt buckle with removable display insert embodying the principles and concepts of the present invention will be described.

As best illustrated in FIGS. 1 through 6, the belt buckle with removable display insert generally comprises a frame with a central opening. A decorative insert is disposed in the central opening of the frame. A backing plate is mounted to a back face of the frame to close the central opening from the back face of the frame so that the decorative insert is visible from the front face of the frame.

In closer detail, the belt buckle comprises an open configuration frame 10 with front and back faces 11,12, and a central opening 13. The front face of the frame may be decorated so that its surface has designs 14 and indicia thereon. Ideally, the frame comprises a solid metal material such as brass, silver, or gold. In a preferred embodiment, the frame may have a generally rectangular outer perimeter and a spaced apart pair of elongate end portions 15,16 and a spaced apart pair of elongate side portions 17,18 extending between the end portions of the frame.

Preferably, the central opening has a generally rectangular outer periphery comprising a pair of elongate end edges 19,20 and a pair of elongate side edges 21,22 extending between the end edges of the central opening. Ideally, the side edges of the central opening are extended substantially parallel to one another and substantially perpendicular to the end edges of the central opening. In the preferred embodiment, the end edges of the central opening are extended substantially parallel to the end portions of the frame and the side edges of the central opening are extended substantially parallel to the side portions of the frame.

Preferably, the back face of the frame has a peripheral groove 23 around the outer periphery of the central opening. Ideally, the peripheral groove has a generally L-shaped transverse cross section comprising a pair of sides 24,25 extending substantially perpendicular to one another. One of the sides of the peripheral groove is preferably extended substantially perpendicular to the back face of the frame while the other of the sides of the peripheral groove is preferably extended substantially parallel to the back face of the frame.

The invention also includes a decorative insert 26 having front and back faces 27,28. Preferably, the decorative insert has a generally rectangular outer perimeter. The front face of the decorative insert has a decorative image 29 such as a photo image displayed thereon. The decorative insert is disposed in the central opening of the frame with the front face of the decorative insert facing in a direction outwards from the front face of the frame and the back face of the decorative insert facing in a direction outwards from the back face of the frame. The outer perimeter of the insert is positioned in the peripheral groove such that the front face of the decorative insert abuts the other side of the peripheral groove.

A backing plate 30 with front and back faces 31,32 is disposed in the central opening to substantially close the central opening from the back face of the frame. The outer perimeter of the backing plate positioned in the peripheral groove. In the preferred embodiment, the backing plate is generally planar and with a rectangular outer perimeter. The front face of the backing plate faces the back face of the decorative insert. The back faces of the backing plate and the frame are preferably generally coplanar with one another.

Figure 3:
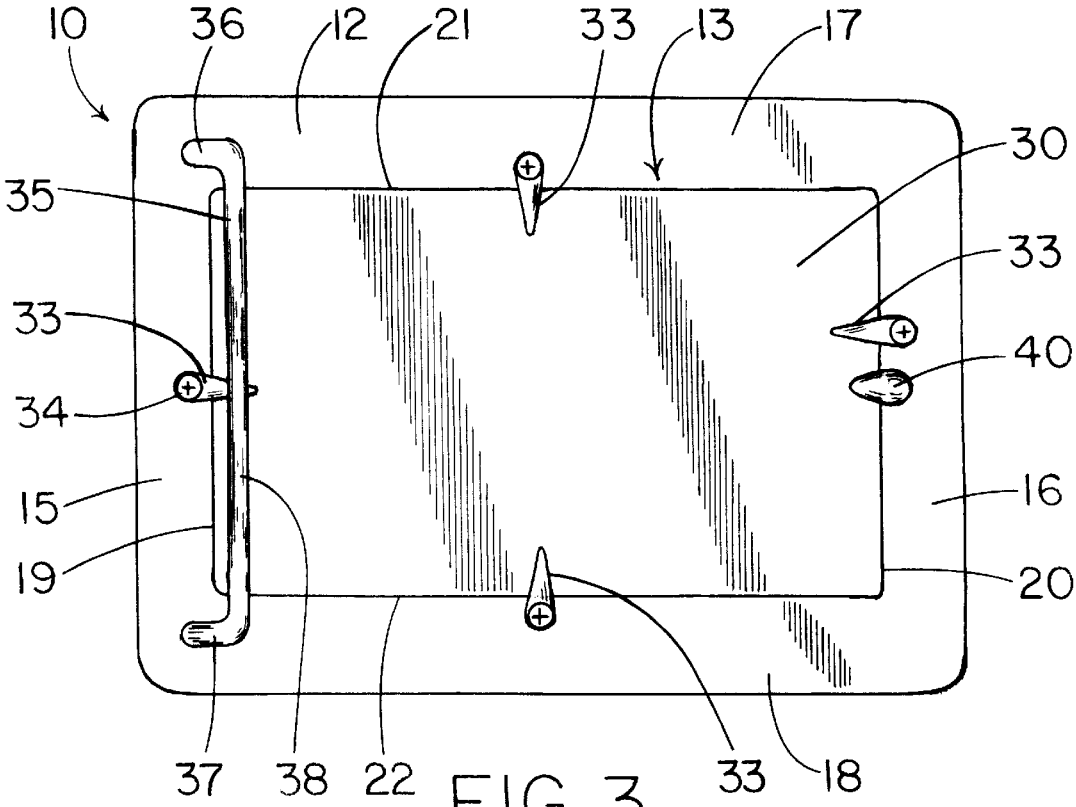
FIG. 3 is a schematic back view of the present invention.
Figure 4:
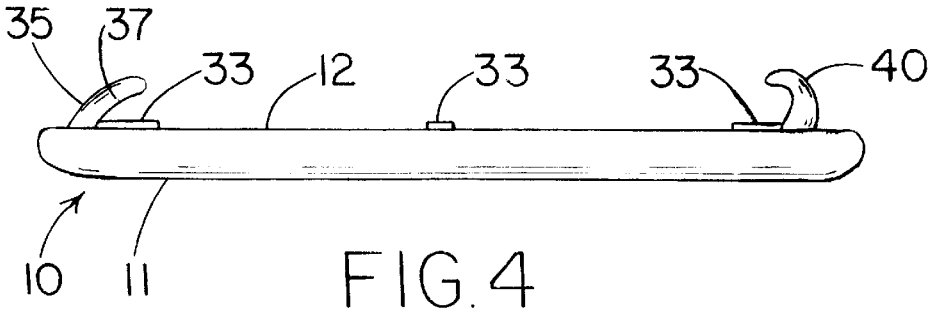
FIG. 4 is a schematic side view of the present invention.

A plurality of spaced apart latches 33 are pivotally coupled (preferably by removable fasteners 34) to the back face of the frame adjacent the central opening. As best illustrated in FIG. 3, each of the latches has a portion pivotally positionable such that the portions of the latches extend inwardly from the outer periphery of the central opening to hold the backing plate in position in the central opening. Preferably, a latch is located in each of the end and side portions of the frame. Ideally, each of the latches of the end portions of the frame is generally equidistantly spaced between the side portions of the frame and each of the latches of the side portions of the frame is generally equidistantly spaced between the end portions of the frame to help ensure that the backing plate is securely held to the frame.

The belt buckle has a belt loop 35 with a spaced apart pair of arcuate arms 36,37 and an elongate cross 38 portion extending between the arms. The arms of the belt loop are coupled to the back face of the frame such that the backing plate is removable from the back face of the frame while the frame is connected to the end of the belt strap. The belt loop is positioned at one of the end portions of the frame with one of the arms of the belt loop positioned adjacent one of the side portions of the frame and the other arm of the belt loop positioned adjacent the other of the side portions of the frame. The cross portion of the belt loop is preferably extended generally parallel to the end portions of the frame, the arms curving towards the other end portion of the frame such that the cross portion of the belt loop is spaced behind the central opening. In use, the belt loop is designed for looping an end of a belt strap 39 therearound to permit securing of the buckle to the end of the belt strap.

A belt hook 40 is coupled the back face of the frame at the other of the end portions of the frame. Preferably, the belt hook curves towards the one end portion of the frame. In use, the belt hook is designed for extending through a belt or punch hole 41 in the belt strap adjacent the other end of the belt strap to couple the ends of the belt strap together with the buckle.

Optionally, a translucent (and ideally transparent) sleeve 42 is included having a similar outer configuration as the decorative insert. As illustrated in FIG. 6, the decorative insert is removably inserted through an end opening 43 into the sleeve such that the sleeve substantially covers the decorative insert. The sleeve is disposed in the central opening with the decorative insert to protect the decorative insert from marks, and other damage. The protective sleeve comprises a pocket With an open end, a closed end and closed sides extending between the open and closed ends. The decorative insert is removably inserted through the open end.

In an ideal illustrative embodiment of the invention, the frame has a thickness defined between the front and back faces of the frame of about 1/16 inch, a length defined between the end portions of the frame of about 3½ inches, and a width defined between the side portions of the frame of about 2⅜ inches.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A belt buckle, comprising:

a frame having front and back faces, and a central opening;

a decorative insert being disposed in said central opening of said frame;

a backing plate being mounted to said back face of said frame to close said central opening from said back face of said frame and such that said decorative insert is visible from said front face of said frame;

a belt hook being coupled to said back face of said frame adjacent to a first end of said frame; and a belt loop having a spaced apart pair of arms and an elongate cross portion extending between said arms the arms of said belt loop being coupled to spaced locations on, said back face of said frame adjacent to a second end of said frame, said belt loop being adapted for looping an end of a belt strap therearound to permit securing of said buckle to the end of the belt strap, said arms of said belt loop being coupled to said back face of said frame such that said backing plate is removable from said back face of said frame while said frame is connected to the end of the belt strap.

2. The belt buckle of claim 1, wherein said back face of said frame having a peripheral groove around an outer periphery of said central opening, wherein an outer perimeter of said decorative insert is positioned in said peripheral groove, and wherein said backing plate has an outer perimeter positioned in said peripheral groove.

3. The belt buckle of claim 2, wherein said peripheral groove has a generally L-shaped transverse cross section comprising a pair of sides extending substantially perpendicular to one another, one of said sides of said peripheral groove being extended substantially perpendicular to said back face of said frame, the other of said sides of said peripheral groove being extended substantially parallel to said back face of said frame.

4. The belt buckle of claim 1, wherein a plurality of spaced apart latches are pivotally coupled to said back face of said frame adjacent said central opening to hold said backing plate in position closing said central opening.

5. The belt buckle of claim 1, further comprising a translucent sleeve, said decorative insert being inserted into said sleeve, said sleeve being disposed in said cental opening with said decorative insert.

6. A belt buckle, comprising;

a frame having front and hack faces, and a central opening;

wherein said frame comprises a metal material;

said frame having a generally rectangular outer perimeter and a spaced apart pair of elongate end portions and a spaced apart pair of elongate side portions extending between said end portions of said frame;

said central opening having a generally rectangular outer periphery comprising a pair of elongate end edges and a pair of elongate side edges extending between said end edges of said central opening;

said side edges of said central opening being extended substantially parallel to one another and substantially perpendicular to said end edges of said central opening;

said end edges of said central opening being extended substantially parallel to said end portions of said frame;

said side edges of said central opening being extended substantially parallel to said side portions of said frame;

said back face of said frame having a peripheral groove around said outer periphery of said central opening;

said peripheral groove having a generally L-shaped transverse cross section comprising a pair of sides extending substantially perpendicular to one another, one of said sides of said peripheral groove being extended substantially perpendicular to said back face of said frame, the other of said sides of said peripheral groove being extended substantially, parallel to said back face of said frame;

a decorative insert having front and back faces, wherein said decorative insert has a generally rectangular outer perimeter, said front face of said decorative insert having a decorative image such that a photo image is displayed thereon;

said decorative insert being disposed in said central opening of said frame, said front face of said decorative insert facing in a direction outwards from said front face of said frame, said back face of said decorative insert facing in a direction outwards from said back face of said frame;

said outer perimeter of said insert being positioned in said peripheral groove such that said front face of said decorative insert abuts said other side of said peripheral groove;

a backing plate being generally rectangular in shape and having front and back faces;

said backing plate being disposed in said central opening to substantially close said central opening from said back face of said frame, said backing plate having a generally rectangular outer perimeter positioned in said peripheral groove;

said front face of said backing plate facing said back face of said decorative insert;

said back faces of said backing plate and said frame being generally coplanar with one another;

a plurality of spaced apart latches being pivotally coupled to said back face of said frame adjacent said central opening, each of said latches having a portion pivotally positionable such that said portions of said latches extend inwardly from said outer periphery of said central opening to hold said backing plate in position in said central opening;

wherein a latch is located in each of said end and side portions of said frame;

a belt loop having a spaced apart pair of arcuate arms and an elongate cross portion extending between said arms;

said arms of said belt loop being coupled to said back face of said frame;

said belt loop being positioned at one of said end portions of said frame, one of said arms of said belt loop being positioned adjacent one of said side portions of said frame, the other of said arms of said belt loop being positioned adjacent the other of said side portions of said frame;

said cross portion of said belt loop being extended generally parallel to said end portions of said frame, said arms curving towards said other end portion of said frame such that said cross portion of said belt loop is spaced behind said central opening;

said belt loop being adapted for looping an end of a belt strap therearound to permit securing of said buckle to the end of the belt strap such that said backing plate is removable from said back face of said frame while said frame is connected to the end of the belt strap;

a belt hook being coupled to said back face of said frame at the other of said end portions of said frame, said belt hook curving towards said one end portion of said frame;

said belt hook being adapted for extending through a belt or punch hole in the belt strap adjacent to the other end of the belt strap to couple the ends of the belt strap together with the buckle;

a translucent protective sleeve, said decorative insert being inserted into said protective sleeve for protecting said decorative insert such that said protective sleeve substantially covers said decorative insert, said protective sleeve being disposed in said central opening with said decorative insert, said protective sleeve comprising a pocket with an open end, closed end and closed sides extending between said open and closed ends, said decorative insert beings removably inserted through said open end; and said frame having a thickness defined between said front and back faces of said frame of about 1/16 inch, a length defined between said end portions of said frame of about 3½ inches, and a width defined between said side portions of said frame of about 2⅜ inches.

* * * * *